US011174601B2

(12) United States Patent
Gundala et al.

(10) Patent No.: US 11,174,601 B2
(45) Date of Patent: Nov. 16, 2021

(54) PAVING MACHINE WITH HOPPER REGULATION SYSTEM

(71) Applicant: Caterpillar Paving Products Inc., Brooklyn Park, MN (US)

(72) Inventors: Subba R. Gundala, Dunlap, IL (US); Mathew J. Hedrington, Ham Lake, MN (US)

(73) Assignee: Caterpillar Paving Products Inc, Brooklyn Park, MN (US)

( * ) Notice: Subject to any disclaimer, the term of this patent is extended or adjusted under 35 U.S.C. 154(b) by 72 days.

(21) Appl. No.: 16/814,588

(22) Filed: Mar. 10, 2020

(65) Prior Publication Data

US 2021/0285168 A1 Sep. 16, 2021

(51) Int. Cl.
*E01C 19/48* (2006.01)

(52) U.S. Cl.
CPC ..... *E01C 19/4873* (2013.01); *E01C 2301/00* (2013.01)

(58) Field of Classification Search
CPC ... E01C 19/48; E01C 19/4873; E01C 2301/00
USPC ..... 404/84.05–84.5, 101–110, 118
See application file for complete search history.

(56) References Cited

U.S. PATENT DOCUMENTS 5,356,238 A 10/1994 Musil et al.
5,752,783 A * 5/1998 Malone ..... E01C 19/006 404/104
6,244,782 B1 * 6/2001 Bitelli ..... E01C 19/48 198/841
6,805,516 B2 * 10/2004 Barnat ..... E01C 19/21 404/101
7,470,082 B2 * 12/2008 Lloyd ..... E01C 23/065 404/110
9,028,167 B2 5/2015 Buschmann et al.
9,151,004 B2 10/2015 Anderson et al.
9,611,595 B2 * 4/2017 Marsolek ..... E01C 19/1063
9,777,442 B2 10/2017 Weiler et al.
10,246,833 B2 4/2019 Blank et al.
2011/0002736 A1 1/2011 Monger et al.
2017/0030027 A1 * 2/2017 Frelich ..... E01C 19/42

FOREIGN PATENT DOCUMENTS

CN 110042735 A 7/2019

* cited by examiner

*Primary Examiner* — Raymond W Addie
(74) *Attorney, Agent, or Firm* — Leydig, Voit & Mayer, Ltd.

(57) ABSTRACT

A paving machine for paving a work surface can include a hopper for receiving, accommodating, and dispensing a paving material. The hopper may be movable into various positions including a conventional configuration, a material receiving configuration, and a material feeding configuration. The paving machine may include a hopper regulation system associated with a material quantity sensor and an object detection sensor and that utilizes data obtained therefrom to decide on proceeding with a material receiving operation, a material feeding operation, or to suspend hopper operation.

20 Claims, 5 Drawing Sheets

PAVING MACHINE WITH HOPPER REGULATION SYSTEM

TECHNICAL FIELD

This patent disclosure relates generally to a paving machine for paving asphalt or other material and, more particularly, to a control system and method for sensing the material accommodated in a movable hopper of the paving machine.

BACKGROUND

Paving machines are used to lay down paving materials to produce roadways and other paved surfaces. In a paving operation that may be conducted by a paving convoy or paving train, the paving machine may follow a dump truck or other loading machine from which it receives the raw aggregate or other paving materials into a hopper disposed at the front of the paving machine. The aggregate or material is conveyed rearward by one or more conveyors though the paving machine to a laterally arranged auger that distributes the aggregate across the unpaved surface. A screed attached at the rear of the paving machine may flatten the distributed aggregate into a mat that may be further compacted by roller compactors following the paving machine.

To enable the paving machine to receive the raw aggregate, the hopper is configured as an opened, box-like structure into which the aggregate may be deposited from above. To facilitate directing aggregate to the conveyors, however, the walls of the hopper assembly move with respect to each other between raised and lowered position. For example, U.S. Pat. No. 9,151,004 ("the '004 patent") describes a paving machine in which the hopper is bifurcated into a left hopper side and a right hopper side and includes a front apron that can be vertically move in upward and downward directions by hydraulics to configure the hopper to either receive paving material or direct the material to the conveyor. The '004 patent also describes an electronic control system through which the operator can interact to selectively control reconfiguration of the hopper. The present disclosure is also directed to an improved electronic control and regulation system for positioning a hopper on a paving machine in different operational configurations.

SUMMARY

The disclosure describes, in one aspect, a paving machine for paving a surface with a paving material that includes a frame supported on a plurality of traction devices and having a front portion and a rear portion and a conveyor to convey a paving material from the front portion and discharge the paving material at the rear portion. To receive and accommodate the paving material from a material loading machine, a hopper can be located at the front portion of the paving machine. The hopper includes a hopper apron configured to be vertically raised and lowered and further includes a first hopper side and a second hopper side configured to be vertically tilted and vertically lowered. To compact the paving material discharged by the paving machine, a screed can be attached to the rear portion. The paving machine can also include an electronic controller programmed with a hopper regulation system to receive a material quantity signal from a material quantity sensor indicating the quantity of material in the hopper and to decide a hopper operation based on the material quantity. The electronic controller is further configured to receive an object detection signal from the object detection sensor indicating proximity of external object with respect to the hopper and to suspend operation of the hopper in if the object detection signal indicates the external object may interfere with the hopper operation.

In another aspect, the disclosure describes a method for hopper operation in a paving machine. The method involves measuring a material quantity of paving material in a hopper on the paving machine and deciding a hopper operation based on the material quantity. The method further involves monitoring an object detection sensor for an object detection signal indicating the detection of an external object in proximity to the hopper and, if the external object is present in an interference zone, the method suspends the hopper operation.

In yet another aspect of the disclosure, there is described a control system for regulating operation of a hopper on a paving machine. The control system includes a material quantity sensor measure a quantity of paving material in a hopper of a paving machine and an object detection sensor to sense presence of an external object with respect to the hopper. The control system also includes an electronic controller in communication with the material quantity sensor and with the object detection sensor. The electronic controller is programmed to determine a hopper operation based on the quantity of paving material measured in the hopper and to suspend the hopper operation if the external object is present in an interference zone.

DETAILED DESCRIPTION

Figure 1:
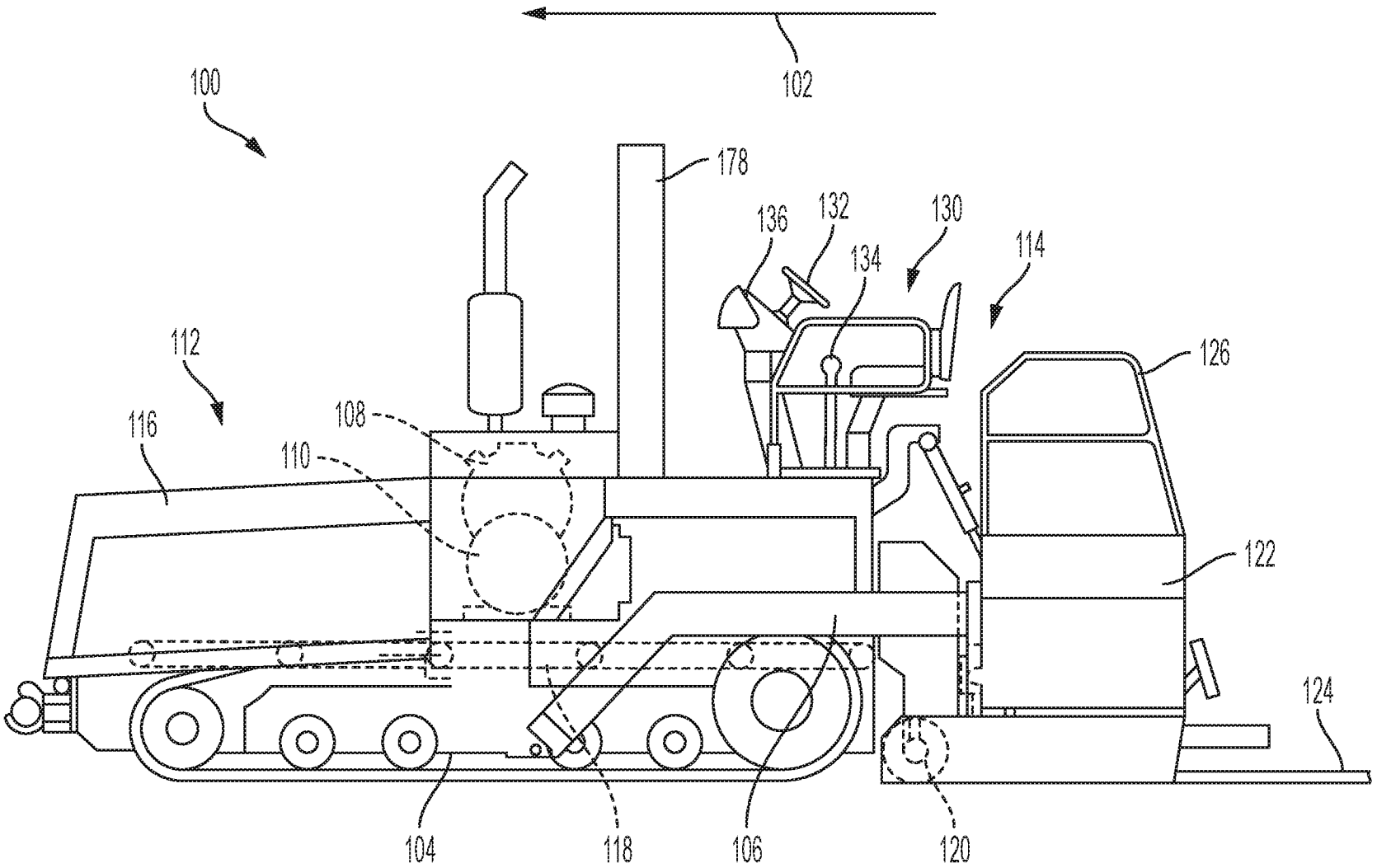
FIG. 1 is a side elevational view of a paving machine configured to receive raw aggregate and other paving materials in a hopper and deposit the material rearward in a mat.

Now referring to the drawings, wherein whenever possible like reference numbers refer to like features, there is illustrated in FIG. 1 an embodiment of a paving machine 100 configured to receive and deposit a paving material such as an aggregate or other materials over an unpaved work surface to construct a roadway or other paved surface. To enable the paving machine 100 to move over the unpaved surface in the travel direction 102 as it deposits paving aggregate, the paving machine can include a plurality of ground engaging traction devices 104 that connect to and support a frame 106 of the paving machine. In the illustrated embodiment, the traction devices 104 can be continuous tracks at least one of which may be disposed on each lateral side of the paving machine 100. In other embodiments, however, the traction devices 104 can be wheels, rollers, or the like. To generate power for driving the traction devices 104 and for operating the other systems on the paving machine 100, a power source such as an internal combustion engine 108 can be included with the machine. An internal combustion engine 108 combusts a hydrocarbon based fuel to convert the chemical energy therein to mechanical power in the form of rotational motion that can be harnessed for other work. In other embodiments, different types of power sources can be used to power the paving machine 100. To transfer power generated by the internal combustion engine 108 for use by other systems on the paving machine 100, the internal combustion engine 108 can be operatively associated with a hydraulic system 110 including a hydraulic pump and a plurality of hydraulic conduits. The hydraulic system 110 can pressurize and direct hydraulic fluid to other locations where hydraulic actuators such as hydraulic cylinders and hydraulic motors convert the pressurized fluid to mechanical forces.

In the travel direction 102, the paving machine 100 can include a front portion 112 and a rear portion 114. To receive paving material from a material delivery machine such as a dump truck or a material transfer vehicle, a hopper 116 can be located on the front portion 112 of the paving machine 100, which can be configured as a rectangular, opened box-like structure defining a volume into which paving aggregate can be dumped from above. The hopper 116 may hold only a limited volume and will require periodic replenishing. To move the received material rearward, one or more conveyors 118 are disposed longitudinally through the paving machine 100 and may be disposed along the centerline between the traction devices 104 to either lateral side of the paving machine 100. The conveyors 118 may be of a closed loop belt or slat construction which provides a conveying surface continuously moving through the paving machine 100. The conveyors 118 can be located toward the bottom of the paving machine 100 and located proximately between the continuous tracks that comprise the traction devices 104 so that paving aggregate received in the hopper assembly is gravity fed to the conveyor.

The conveyors 118 extend from the front portion 112 toward the rear portion 114 where the paving material or aggregate is disposed behind the paving machine 100. To laterally disperse the paving aggregate, an auger 120 is included on a rear portion 114, arranged traverse or perpendicular to the travel direction 102 and which may be located below the rear end of the conveyor 118. The auger 120 may be structured as a helical screw that can rotate to direct paving aggregate from the centrally located conveyor 118 laterally across the rear portion 114 of the paving machine 100 and evenly deposit the material on the unpaved surface. Attached to the rear portion 114 of the paving machine 100 can be a device referred to as a screed 122, which can be a type of floating vibratory compactor. As the screed 122 is pulled over and on top of the deposited paving material by the forward travel of the paving machine 100 in the travel direction 102, the screed provides a degree of compaction to the underlying material to form a flattened compacted layer of paving material referred as a mat 124 behind the paving machine 100. It will be appreciated that to further compact the mat 124, the paving machine 100 may be followed by one or more roller compactors. To enable visual observation of the mat 124 being deposited behind the paving machine 100, the upper portion of the screed 122 can include a walkway 126 laterally traverse to the travel direction 102 for operators and other individuals stand on and view rearward of the machine to observe the paving process.

To accommodate an operator or other individuals, an operator station 130 can be disposed above the frame 106 in a location to provide visibility about and around the paving machine 100. The operator station 130 can include the inputs and controls for an operator to maneuver and operate the paving machine 100 during a paving operation. For example, the operator station 130 can include a steering wheel 132 or another steering input that can manipulate the traction devices 104 to maneuver the paving machine 100. To select the direction of travel of the paving machine 100, the operator station 130 can include a forward-neutral-reverse lever 134 that is configured to shift the paving machine 100 to move forward in the travel direction 102, reverse, or places the paving machine in neutral. The operator station 130 can also include a control panel 136 on which are disposed dials, switches, and the like to interface with the operator. In an embodiment, the control panel 136 can include a visual interface like a touch screen display, also referred to as a human machine interface (HMI) to interact with the operator. The control panel 136 provides information about the operation of the paving machine 100 and the subsystems thereon during the paving operation that should be watched.

Figure 2:
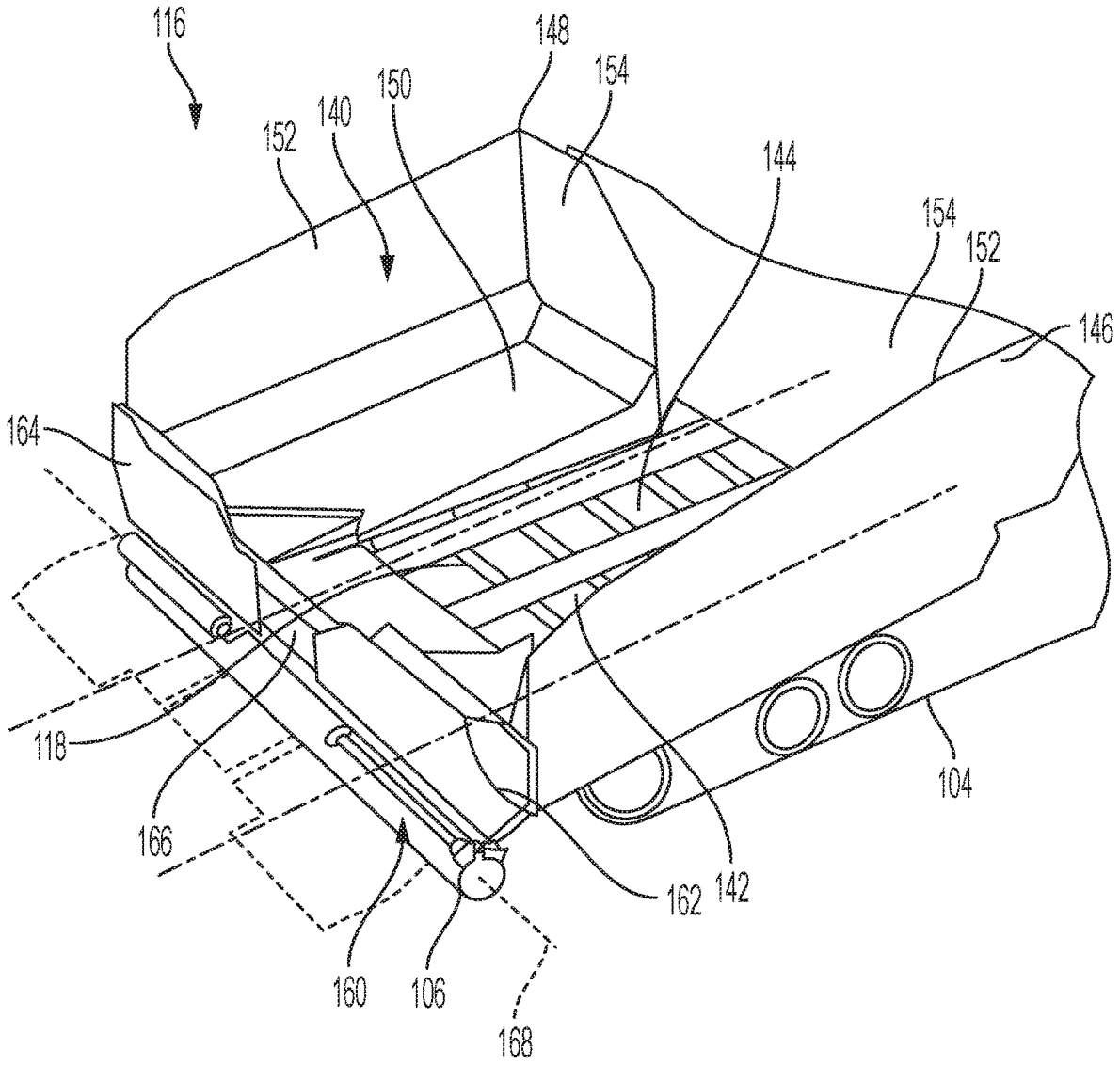
FIG. 2 is a perspective view of the hopper positioned in a conventional configuration to dispense paving material with the hopper apron alternatively illustrated in dashed lines in a material receiving configuration to be replenished with paving material.
Figure 3:
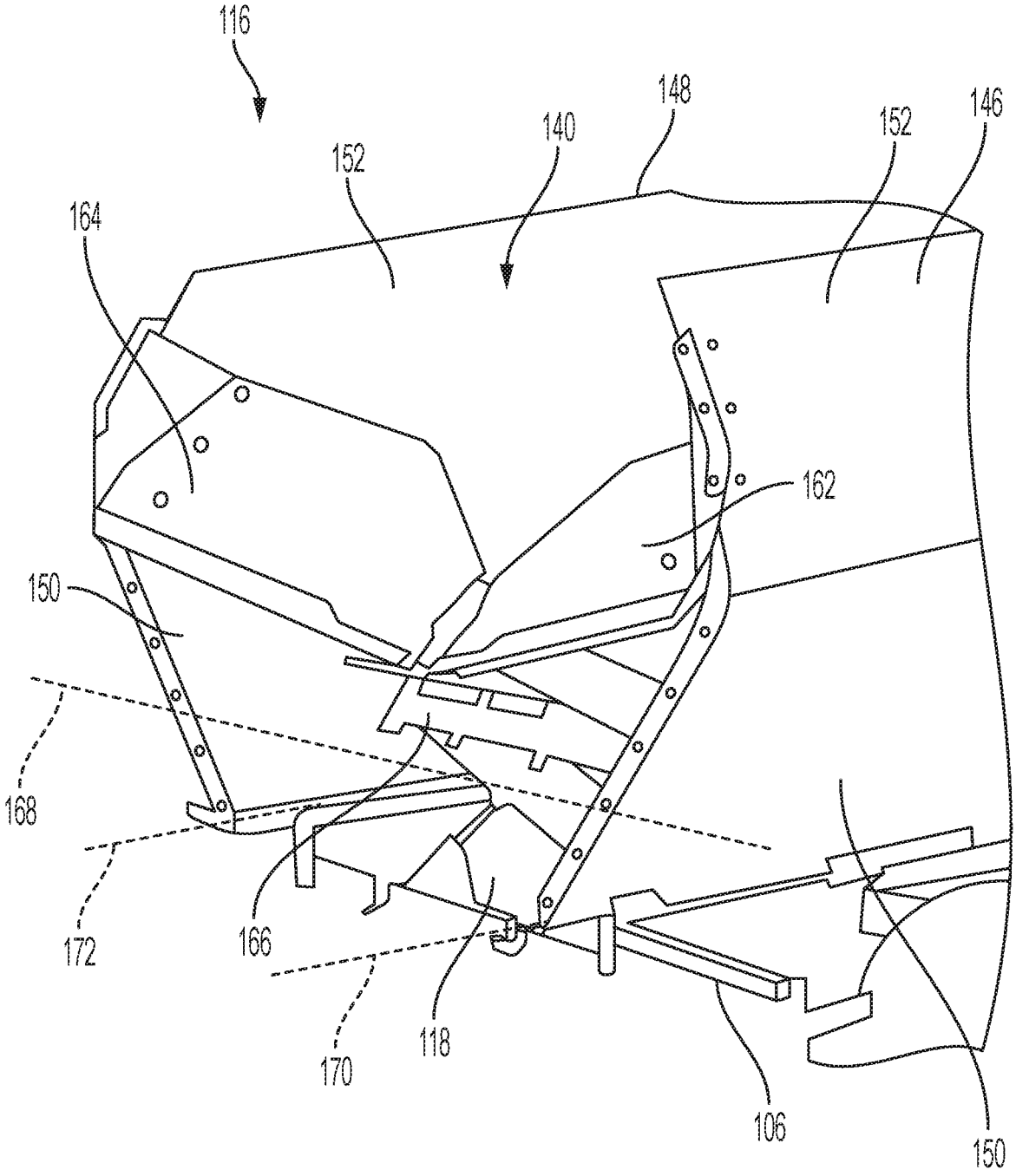
FIG. 3 is a perspective view of the hopper positioned in a material feeding configuration with the first and second hopper sides vertically tilted to gravity feed paving material to the conveyor.

Referring to FIGS. 2 and 3, to receive, accommodate, and direct the paving material, the hopper 116 can be adjustable through various movements and into different positions and configurations and can be assembled from a plurality of movable components. In a conventional configuration illustrated in FIG. 2 and as described above, the hopper 116 typically is configured to provide box-like structure delineating an opened region 140 in which the paving material can be accommodated and gravity-fed to the conveyor 118. The conveyor 118 can be disposed at the bottom of the hopper 116 and is communicable with the opened region 140. In the illustrated embodiment, the conveyor 118 can include a first conveyor track 142 and a second conveyor track 144 arranged in a side-by-side configuration and extending longitudinally through the paving machine 100, but in other embodiments may consist of only a single track.

Because the conveyor 118 is centrally disposed along the centerline of the paving machine 100, the conveyor may separate the hopper 116 into a first hopper side 146 and a symmetrically opposed second hopper side 148. When viewed rearward from the operator station 130, the first hopper side 146 and second hopper side 148 can also be referred to as the "right hopper side" and the "left hopper side" respectively. The first and second hopper sides 146, 148 can have a L-shaped cross-section including a horizontally disposed hopper floor 150 and a vertical hopper sidewall 152 arranged at a right angle to and integrally attached with the hopper floor. The hopper floor 150 can support the paving material contained in the opened region 140 and the hopper sidewall 152 can contain the paving material in the opened region. To further contain the paving material, a vertical rear wall 154 can be located at the rear ends of the first and second hopper sides 146, 148 and disposed normally to the hopper floor 150 and hopper sidewall 152, while the front ends remain generally opened for accessibility. The first and second hopper sides 146, 148 can be symmetrically arranged on opposite lateral sides of the conveyor 118.

To permit and restrict access to the opened region 140, a swingable hopper apron 160 can be pivotally disposed along the front end of the hopper 116 and can be laterally traverse to the travel direction 102 and the longitudinal centerline of the paving machine 100. The hopper apron 160 can include a first apron side panel 162 operatively associated with the first hopper side 146, a second apron side panel 164 operatively associated with second hopper side 148, and an apron central panel 166 flanked between the first and second hopper side panels 162, 164 and linearly aligned with the conveyor 118. The first apron side panel 162, second apron side panel 164, and apron central panel 166 can be generally planar and generally rectangular in shape. The swingable hopper apron 160 can function as a gate to the opened region 140 of the hopper 116 and, while in a vertically raised position in the conventional configuration illustrated in FIG. 2, encloses the opened region 140 to contain paving material accommodated in the hopper 116. When in the vertically raised position, the first and second apron side panels 162, 164 and the apron central panel 166 align in a vertical plane extending across and perpendicular to the first and second hopper sides 146, 148. To receive additional paving material from a material delivery machine (e.g. a dump truck or material transfer machine), the hopper apron 160 can be pivotally lowered about an apron axis 168 into a horizontal or lowered position and thereby provides access to the opened region 140 through the front of the hopper 116. The vertically lowered position of the hopper apron may be referred to as the material receiving configuration of the hopper 116. To pivot the hopper apron 160 between the vertically raised position and the vertically lowered position, the first and second side apron panels 162, 164 and the apron central panel 166 can be operatively associated with one or more hydraulic actuators such as hydraulic cylinders receiving pressurized hydraulic fluid from the hydraulic system associated with the paving machine 100.

As the paving material is depleted from the opened region 140 during a paving operation, material may accumulate in locations of the first and second hopper sides 146, 148 that are inaccessible to the conveyor 118. Accordingly, to direct the accumulated material to the conveyor 118, the first and second hopper side 146, 148 can be vertically tilted upwards to a raised position as illustrated in FIG. 3. For example, the first hopper side 146 can be pivotally connected to the frame 106 of the paving machine 100 along an edge of the first hopper side that extends adjacent to the conveyor 118. The pivotal connector delineates a first hopper axis 170 adjacent the conveyor 118 and parallel to the travel direction 102 and the longitudinal center line of the paving machine 100. The second hopper side 148 can be similarly pivotally connected adjacent to the conveyor to delineate a second hopper axis 172 parallel to and spaced apart from the first hopper axis 170. When the first and second hopper sides 146, 148 are vertically tilted about the first and second hopper axes 170, 172 from the lowered positions illustrated in FIG. 2 to the vertically raised positions illustrated in FIG. 3, the hopper floor 150 and integral hopper sidewall 152 become oriented in a generally vertical position to gravity-fed the paving material to the centrally disposed conveyor 118. In addition, the first and second apron side panels 162, 164 can the apron central panel 166 can be configured to partially collapse upon themselves so that the hopper apron 160 accordingly moves to enable vertically tilting of the first and second hopper sides 146, 148. To vertically tilt and lower the first hopper sides 146 and the second hopper side 148, the first and second hopper sides can be operatively associated with respective hydraulic actuators such as hydraulic cylinders included with the hydraulic system associated with the paving machine 100. The vertically raise position of the first hopper side 146 and second hopper side 148 illustrated in FIG. 3 may be referred to as the material feeding configuration of the hopper 116. Tilting and raising the first and second hopper sides 146, 148 to the vertically raised position may occur gradually in time so that direction of the paving to the conveyor 118 under gravity is reasonably restrained and will not overload the conveyor.

Figure 4:
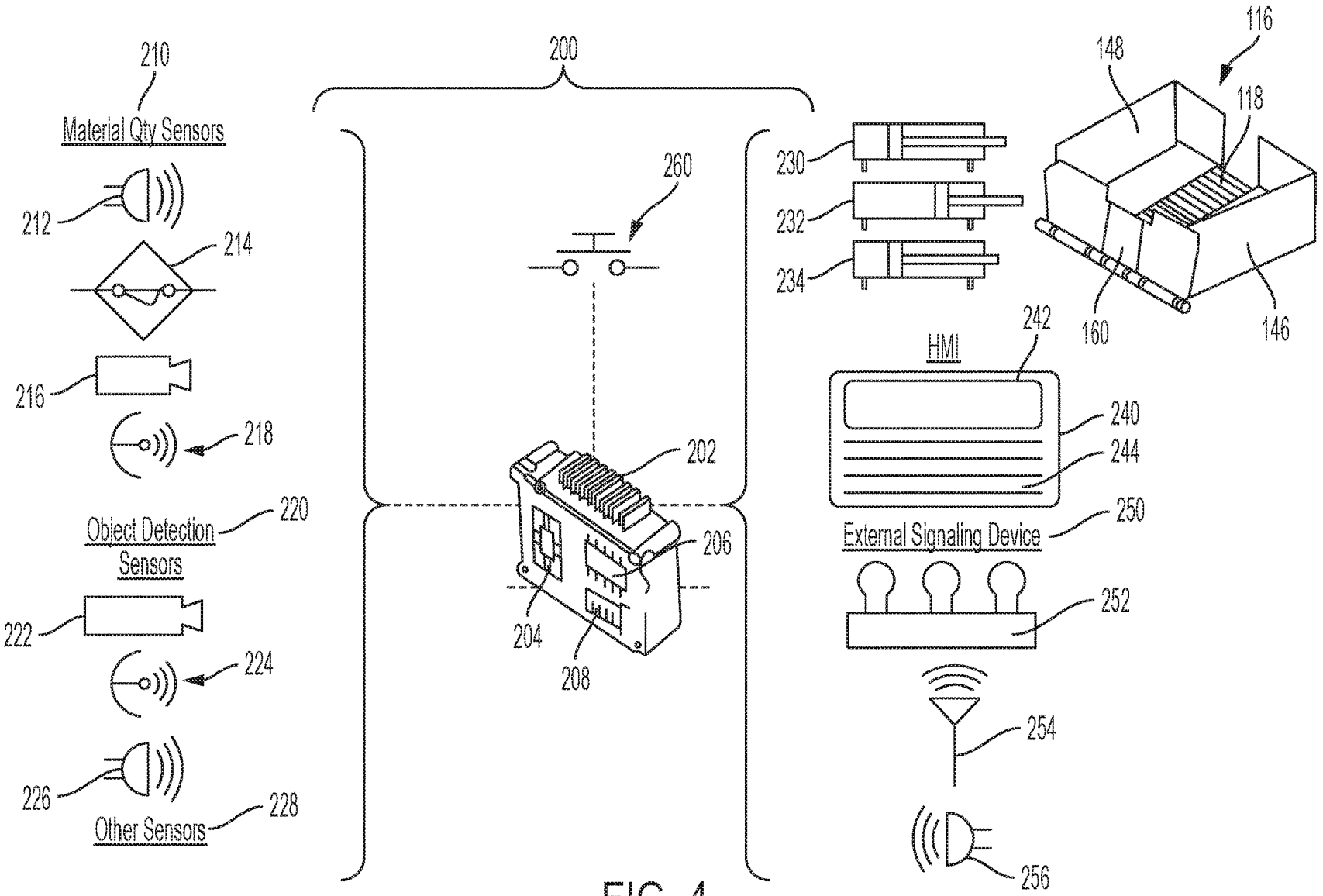
FIG. 4 is a schematic representation of a hopper regulation system that can be used to control operation and positioning of the hopper in accordance with the disclosure.

To assist in operating the hopper 116 to receive and manipulate the paving material, the paving machine 100 can be operatively configured with a hopper regulation system 200. Referring to FIG. 4, the hopper regulation system 200 can be implemented in an electronic controller 202 sometimes referred to as an electronic control module, an electronic control unit, or sometimes just a controller. To perform the associated functions and operations of the hopper regulation system 200, the electronic controller 202 can include one or more microprocessors 204 such as an application specific integrated circuit ("ASIC"), a field programmable gate array ("FPGA"), or other appropriate processing circuitry, and can include non-transient data and programmable memory 206, which may be in the form of random access memory and/or more permanent forms of data storage for storing software associated with the hopper regulation system. The microprocessor 204 may be capable of processing or performing any suitable computer-based functions, such as executing instructions, data processing, mathematical operations, and the like. The electronic controller 202 may also include input/output ports and circuitry 208 to communicate with other electronic devices. The electronic controller 202 may be associated with other software including any suitable instruction sets, programs, applications, routines, libraries, databases, and the like, for carrying out its functions. Although in FIG. 4, the electronic controller 202 is illustrated as a single, discrete unit, in other embodiments, the electronic controller 202 and its functions may be distributed among a plurality of distinct and separate components.

To receive information about the operating characteristics and performance of the paving machine 100, the hopper regulation system 200 can be operatively associated with a plurality of sensors and controls disposed about the paving machine and in electronic communication with the electronic controller 202. For example, to determine the quantity of paving material accommodated in the hopper, the hopper regulation system 200 can be associated with one or more material quantity sensors 210 that are configured to measure the material quantity by, for further example, weight or volume. An example of a material quantity sensor 210 can be an ultrasonic sensor 212 that uses ultrasonic or acoustic waves to determine the height of paving material in the hopper. The ultrasonic sensor 212 includes an ultrasonic transducer that can transmit and receive ultrasonic waves and convert the received waves into an electrical signal. The ultrasonic sensor 212 can be disposed on the paving machine 100 in a location where it has access to the opened region 140 of the hopper 116, for example, on the mast 178 positioned above the hopper 116 as illustrated in FIG. 1. The ultrasonic sensor 212 transmits an ultrasonic or acoustic wave at the paving material and receives the reflected wave back. Using known distances between the ultrasonic sensor 212 and the hopper, the time delay between transmitting and receiving waves can be converted to determine the height of the paving material, which can further be converted to the material quantity. The material quantity can be communicated as electronic data via an electrical signal to the electronic controller 202 via, for example, conductive wires, data buses, optical fibers, and other communication mediums.

Another example of a material quantity sensor 210 can be an electromechanical switch 214. The electromechanical switch 214 can be physically located in the hopper to physically interact with the paving material. As the height or volume of paving material changes, the electromechanical switch 214 can output a varying electric signal to the electronic controller 202 that is indicative of the material height or volume and which the electronic controller can convert to the material quantity. Another example of a material quantity sensor 210 can be visual in operational characteristics and can include a camera 216. The camera 216 is configured to record visual images using, for example, a photo-electronic sensor and can be located on the paving machine directed toward the hopper. The camera 216 can take images of the paving material which the electronic controller 202 can digitally analyze to determine the material quantity. In an embodiment, the camera 216 can be a stereo camera having multiple lenses configured to capture three-dimensional images that provide information about the shape and quantity of the paving material in the hopper. Yet another example of a material quantity sensor 210 can be a short-range radar 218 in which radiowaves are transmitted toward and reflected back from the paving material in the hopper. Similar to the ultrasonic sensor 212, the time delay between transmission and reception can be used to determine the material height which can be converted to material volume and/or quantity. Other examples of material quantity sensors 210 can include a LIDAR system utilizing light waves, weight scales disposed in the hopper, and others.

The hopper regulation system 200 can also be operatively associated with one or more object detection sensors 220 that can sense and gather information about the operative environment around the paving machine 100. In contrast to the material quantity sensors 210 that are directed and focused towards the hopper, the object detection sensors 220 are outwardly directed and focused to sense the presence and position of external objects with respect to the paving machine 100 and in particular the hopper 116. The object detection sensor 220 can be mounted to the frame 106 of the paving machine 100 and oriented toward the surrounding environment. An example of an object detection sensor 220 can include a camera 222 that can capture visual images via a photo-electric sensor that the electronic controller 202 can analyze to determine the presence and proximity of an object with respect to the hopper. Another example of an object detection sensor 220 can be a short-range radar transmitting and receiving radiowaves from an antenna that provides information about the surrounding environment. Another example of an object detection sensor 220 can be a radar-based sensor 224 or an ultrasonic sensor 226 utilizing ultrasonic or acoustic waves in a manner similar to radar to detect and determine the position of an object with respect to the hopper. To gather additional information about the operating characteristics of the paving machine 100, the hopper regulation system 200 can operatively associated with other sensors 228 such as, for example, a conveyor sensor that measures the rate of discharge and use of paving material To enable the hopper regulation system 200 to configure and positon the hopper 116 in different configurations, the electronic controller 202 can be operatively associated with controls that control the actuators facilitating movement of the first and second hoper sides and the hopper apron. For example, the electronic controller 202 can control the operation of a hydraulic first hopper side actuator 230, which may be a hydraulic cylinder that can extend and retract to vertically tilt and lower the first hopper side 146 as described above. Physical control may be accomplished through a flow control valve that controls the flow and/or direction of pressurized hydraulic fluid to and from the first hopper side actuator 230. To vertically tilt and lower the second hopper side 148, the electronic controller 202 can controllably activate a second hopper side actuator 232. Likewise, to raise and lower the hopper apron 160, the electronic controller 202 can controllably activate a hydraulic apron actuator 234. Instead of hydraulic actuators, in other embodiments, electric motors and mechanical gearing may be used to raise and lower the first and second hopper sides and hopper apron.

To interface with an operator of the paving machine 100, the hopper regulation system 200 can also be operatively associated with a human-machine interface (HMI) 240 that can be included with the control panel described above. The HMI 240 can include a visual display 242 such as an LCD screen or the like to output data and information regarding the operation of the paving machine 100 and the hopper in particular. The visual display 242 may also include touch screen capabilities. Other outputs may include gauges and dials. To receive input, the HMI 240 can include a keypad 244, or other dials, knobs, and switches.

To communicate with a material delivery machine or with other machines and individuals in proximity to the paving machine, the hopper regulation system 200 can be operatively associated with an external signaling device 250. For example, the external signaling device may be a plurality of lights 252 (incandescent or LED) disposed in a highly visible location on the paving machine 100. The plurality of lights 252 may be of different colors representing different signals and interpretably by others, such as the familiar red-green-yellow. The electronic controller 202 can selectively activate specific colors of lights to transmit information regarding the paving machine 100 and paving operation. Another example of an external signaling device can be a transmitter/receiver 254 that can send and receive short range radiowaves with similar transmitter/receivers as a form of data transmission. The transmitter/receiver 254 can operate on a WiFi network, Bluetooth network, cellular network, or utilize any other suitable communication protocol. Another example of an external signaling device can be an audio device 256 such as a speaker for audible communication.

In an embodiment, to selectively activate and deactivate the hopper regulation system 200, the electronic controller 202 can be in communication with an activation button switch 260 that, when depressed, completes an electric circuit and electrically signals the electronic controller accordingly. In other embodiments, the hopper regulation system 200 can be activated by a datalink or can be self-activating upon particular operational settings of the paving machine 100.

INDUSTRIAL APPLICABILITY

Figure 5:
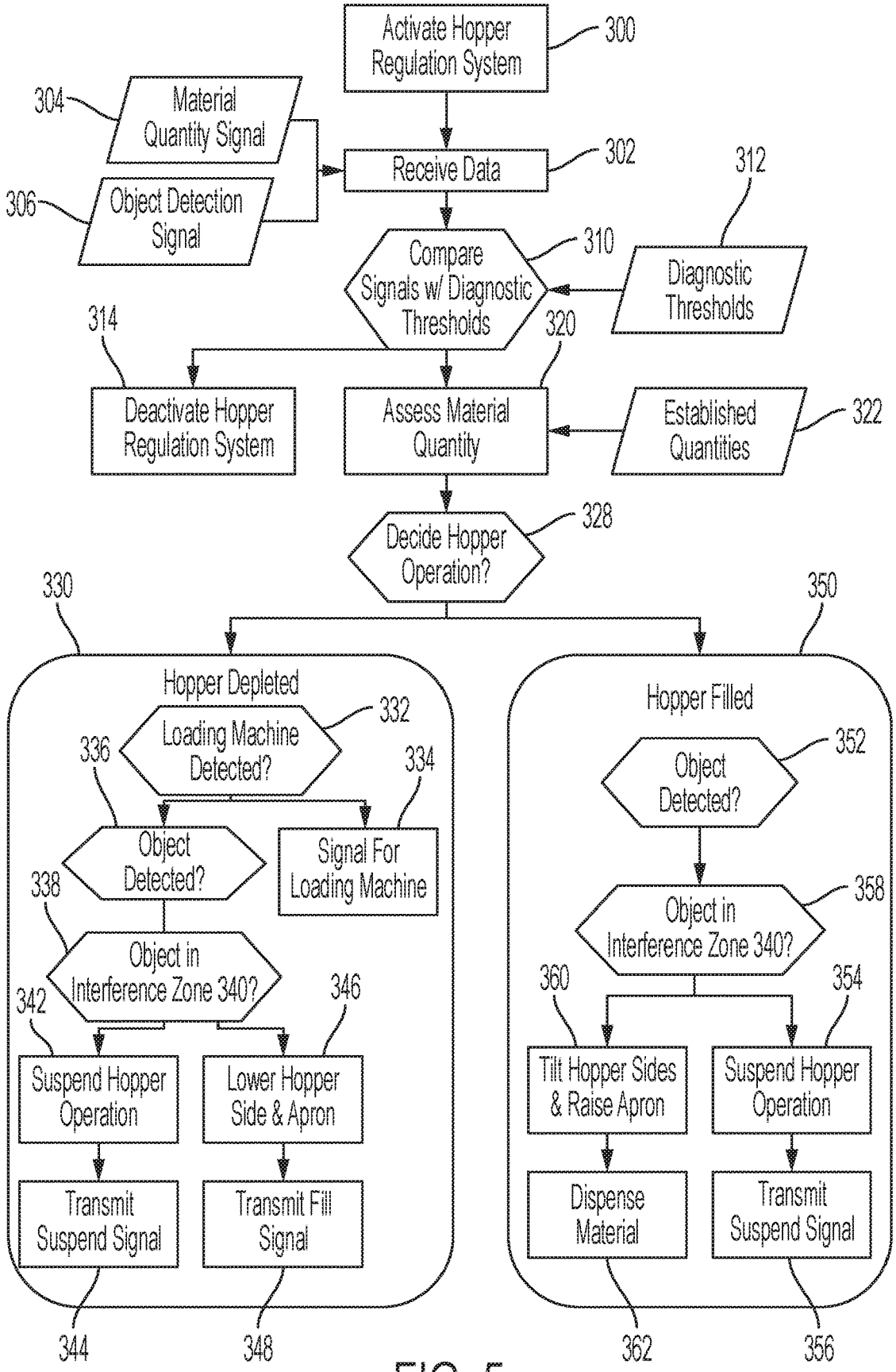
FIG. 5 is a flow diagram of a possible method for electronic implementation of the hopper control system to conduct or suspend a hopper operation.

The present disclosure is applicable to controlling the operation of a hopper on a paving machine to receive, accommodate, and distribute paving material during a paving operation. Referring to FIG. 5 and in general accordance with the prior figures, there is illustrated an exemplary process that may be performed by the hopper regulation system 200. The process depicted in the flow diagram for accomplishing these tasks may include a series of steps or instructions implemented as non-transitory computer executable software code in the form of an application or program. In an initial activation step 300, the hopper regulation system 200 can be selectively activated by an operator or may automatically activate upon certain settings or configurations of the paving machine 100. The hopper regulation system 200 can, in a data reception step 302 receive data and information about the paving operation and about the configuration and condition of the hopper 116 in particular. For example, to determine the quantity of paving material in the opened region 140 of the hopper 116, the hopper regulation system 200 can receive a material quantity signal 304 from one or more of the material quantity sensors 210 described above. The material quantity signal 304 can be indicative of or interpretable as the material quantity and can be embodied as an electronic signal transmittable via an electronic communication pathway.

To assess the presence and location of an external object such a person, equipment, trees, and the like with respect to the hopper 116, the data reception step 302 can receive an object detection signal 306 from one or more of the object detection sensors 220 described above. In an embodiment, the object detection signal 306 may merely represent the presence of an object within a predetermine range or proximity to the hopper 116 without further information and thus represents a confirmatory acknowledgment. In another embodiment, the object detection signal 306 may encode data about the distance of the object and its directional location with respect to the hopper 116. In other embodiments, including those utilizing a camera 222, the electronic controller 202 can be programmed with image analysis software to recognize and identify the object.

In an embodiment, the hopper regulation system 200 can perform a diagnostics step 310 to assess the integrity of the material quantity sensors 210, the object detection sensors 220, and possible other sensors 228 associated with the paving machine 100. For example, the diagnostics step 310 can compare the material quantity signal 304 and the object detection signal 306 with diagnostic thresholds 312 that are threshold values of predetermined, acceptable values for the material quantity and/or detected objects. The diagnostic thresholds 312 can be electrical values measured in voltage or current that are comparable in value with the measured material quantity signal 304 or measured object detection signal 306. If the measured material quantity signal 304 or measured object detection signal 306 exceeds or is below the diagnostic thresholds 312, the hopper regulation system 200 can implement a deactivation step 314 in which the hopper regulation system deactivates itself. The deactivation step 314 may also communicate information to an operator or other individual about a fault condition of the material quantity sensor 210, object detection sensor 220, or other sensors 228 associated with the hopper regulation system 200.

If the diagnostics step 310 determines that the hopper regulation system 200, including the material quantity sensor 210 and the object detection sensor 220, are functioning acceptably, the hopper regulation system 200 can proceed to assess the measured material quantity. In a material quantity assessment step 320, the hopper regulation system 200 can assess the material quantity in the hopper 116 as informed by the material quantity signal 304. For example, the material quantity may be assessed against known or established quantities 322 of paving material that the hopper 116 can accommodate. The established quantities 322 can be the total volumetric capacity of the hopper 116 and the material quantity assessment step 320 can determine the measured material quantity as a percentage or ratio of the established quantities 322. The material quantity assessment step 320 may therefore determine the hopper 116 is sufficiently filled with paving material for continuing the paving operation or may be approaching depletion and require replenishment. Based on the material quantity assessment step 320, the hopper regulation system 200 can make a hopper operation decision 328 in which it determines a hopper operation to conduct, for example, by moving the hopper 116 into one of the aforementioned hopper configurations.

For example, if the material quantity assessment step 320 determines the paving material is approaching depletion, the hopper operation decision 328 can attempt to conduct a material receiving operation 330 to replenish the hopper 116 with paving material. The material receiving operation 330 can, in an initial load machine determination 332, determine if a material loading machine such as a dump truck or material transfer machine is in sufficient proximity to the paving machine 100. This may be accomplished, for example, using the external signaling devices 250 including the transmitter/receiver 254 to communicate with a material loading machine. In another embodiment, the loading machine determination 332 can utilize the object detection sensor 220 to determine if a material loading machine is in sufficient proximity. If no material loading machine is sufficiently close, the hopper regulation system 200 can, in a signaling step 334 transmit a signal requesting a material loading machine be dispatched or made available to replenish the hopper 116.

If a material loading machine is present, the hopper regulation system 200 can conduct one or more steps to determine if it can safely reposition the hopper 116 into the material receiving configuration without interference from external objects including personnel, other machines, etc. For example, in an object detection decision 336, the object detection signal 306 received in the data reception step 302 can be analyzed by the electronic controller 202 to determine if an object is in spatially proximity to the hopper 116. In an embodiment, the object detection decision 336 can be a simple binary decision in which the hopper regulation system 200 interprets detection of an object by the object detection sensors 220 as indicating the object is in sufficient proximity to interfere with repositioning of the hopper 116, and particularly with vertically lowering the first and second hopper sides 146, 148 and/or the hopper apron 160. In another embodiment, the hopper regulation system 200 can conduct a proximity decision 338 in which the proximity of the detected object to the hopper 116 is evaluated. For example, the object detection sensors 220 can communicate data representing the measured distance of the detected object with respect to the hopper 116 and the proximity decision 338 can compare that distance with a predetermined value such as an interference zone 340. The interference zone 340 can be a predetermined proximity range or area about the paving machine 100 inside of which the detected object will likely interfere with repositioning of the hopper including vertically lowering the first and second hopper sides 146, 148 and/or the hopper apron 160.

If the object detection decision 336 and/or the proximity decision 338 determine that the detected object is sufficient close to interfere with repositioning of the hopper 116, the hopper regulation system 200 can conduct a suspension step 342 in which, via the electronic controller 202 the material receiving operation 330 is suspended. For example, the suspension step 342 can prevent movement of the first and second hopper sides 146, 148 and/or the hopper apron 160 into the material receiving configuration. In addition, the suspension step 342 can transmit a suspend signal 344 using the external signaling device 250 to inform paving operators, material supply machines and others the material receiving operation 330 has been suspended. If, however, the object detection decision 336 detects no external objects or the proximity decision 338 determines the detected objects are outside the interference zone 340, the hopper regulation system 200 can proceed with the material receiving operation and in a positioning step 346 continues to lower the first and second hopper sides 146, 148 and the hopper apron 160 to the material receiving configuration illustrated in FIG. 2 to accept paving material. If the material receiving operation does proceed, the hopper regulation system 200 can conduct another signaling step 348 in which a fill signal is transmitted to the material loading machine indicating that the hopper is accessible for replenishment. The signaling step 348 may utilize any of the external signaling device 250 to transmit the fill signal.

Alternatively, if the material quantity assessment step 320 determines the hopper 116 is sufficiently filled with paving material to continue paving, the hopper operation decision 328 can attempt to conduct a material feeding operation 350 to continue feeding paving material to the conveyor 118. The material feeding operation 350 can be facilitated in part by vertically tilting the first and second hopper sides 146, 148 to the material feeding configuration as illustrated in FIG. 3. Prior to tilting the first and second hopper sides 146, 148, the hopper regulation system 200 can determine if an external object may be present and in such proximity to interfere with repositioning or reconfiguration of the hopper 116. This can be accomplished in another object detection decision 352 in which the presence of an external object sensed by the object detection sensor 220 results in a binary decision to implement a suspension step 354 in which the material feeding operation 350 is suspended. The suspension step 354 can prevent further movement of the first and second hopper sides 146, 148 and/or the hopper apron 160 into the material feeding configuration. The suspension step 354 can also transmit a suspension signal 356 indicating that the material feeding operation has been suspended. Alternatively, the hopper regulation system 200 can conduct a proximity decision 358 similar to that described above to determine if the detected object is within an interference zone with respect to the hopper.

If, however, the object detection decision 352 and/or the proximity decision 358 determines there are no external objects to interfere with repositioning of the first and second hopper sides 146, 148 and/or the hopper apron 160, the hopper regulation system 200 can proceed to vertically tilt the first and second hopper sides upwards to gravity feed paving material to the conveyor 118 in a hopper side tilting step 360. If the material feeding operation 350 does proceed, the paving machine 100 can proceed to a discharge step 362 to dispense material from the rear to pave the work surface.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A paving machine for paving a work surface comprising:

a frame supported on a plurality of traction devices and having a front portion and a rear portion;

a conveyor disposed in the frame to convey a paving material from the front portion and discharge the paving material at the rear portion a hopper disposed at the front portion for receiving and accommodating the paving material from a material loading machine, the hopper including a hopper apron configured to be vertically raised and lowered, the hopper further including a first hopper side and a second hopper side configured to be vertically tilted and vertically lowered;

a screed attached to the rear portion of the paving machine to compact the paving material discharged by the conveyor;

an electronic controller programmed with a hopper regulation system operatively associated with a material quantity sensor and an object detection sensor, the hopper regulation system adapted to a) receive a material quantity signal from the material quantity sensor indicative of a material quantity in the hopper; b) decide a hopper operation based on the material quantity measured in the hopper; c) receive an object detection signal from the object detection sensor indicating detection of an external object with respect to the hopper; and d) suspend the hopper operation if the object detection signal indicates the external object is present in an interference zone.

2. The paving machine of claim 1, wherein the hopper operation is a material feeding operation in which the first hopper side and the second hopper side are vertically tilted to direct the paving material to the conveyor and the hopper apron is vertically raised.

3. The paving machine of claim 1, wherein the material quantity sensor is selected from the group comprising an ultrasonic sensor, a photoelectric sensor, a camera, radar, and an electromechanical switch.

4. The paving machine of claim 1, wherein the object detection sensor is selected from the group comprising a camera, radar, and an ultrasonic sensor.

5. The paving machine of claim 1, wherein the hopper regulation system further includes a diagnostics routine in which the material quantity signal and the object detection signal are compared with diagnostics thresholds.

6. The paving machine of claim 1, wherein the hopper regulation system compares the object detection signal with a predetermined proximity range to determine if the object is present in the interference zone.

7. The paving machine of claim 1, wherein the hopper operation is a material receiving operation in which the first hopper side, the second hopper side, and the hopper apron are positioned in a vertically lowered position to receive the paving material from a material loading machine.

8. The paving machine of claim 7, wherein the material receiving operation further includes transmitting a fill signal to the material loading machine if the hopper operation is not suspended.

9. The paving machine of claim 8, wherein the fill signal is selected from the group comprising a visual signal, an audio signal, and a radio-wave signal.

10. A method of regulating hopper operation in a paving machine comprising:

measuring a material quantity of a paving material in a hopper on the paving machine;

deciding a hopper operation based on the material quantity;

monitoring an object detection sensor for an object detection signal indicating detection of an external object with respect to the hopper; and suspending hopper operation if the external object the object detection signal indicates the external object is present in an interference zone.

11. The method of claim 10, wherein the hopper operation is a material receiving operation including the step of positioning a first hopper side, a second hopper side, and a hopper apron in a vertically lowered position to receive the paving material from a material delivery machine.

12. The method of claim 11, wherein the material receiving operation including transmitting a fill signal to the material delivery machine.

13. The method of claim 12, further comprising determining presence of a material loading machine prior to deciding the hopper operation.

14. The method of claim 13, wherein presence of the material loading machine is determined with the object detection sensor.

15. The method of claim 14, wherein the hopper operation is a material feeding operation including the step of positioning the hopper apron in a vertically raised position and vertically tilting the first hopper side and the second hopper side to direct the paving material to a conveyor disposed in the paving machine.

16. The method of claim 15, further comprising comparing the object detection signal with a predetermined proximity range to determine if the object is present in the interference zone.

17. A hopper regulation system for a paving machine comprising:

a material quantity sensor operably configured to measure a quantity of a paving material in a hopper of a paving machine;

an object detection sensor operably configured to sense presence of an external object with respect to the hopper; and an electronic controller in electronic communication with the material quantity sensor and with the object detection sensor, the electronic controller programmed to a) determine a hopper operation based on the quantity of paving material measured in the hopper and b) to suspend the hopper operation if the external object is present in an interference zone.

18. The hopper regulation system of claim 17, wherein the material quantity sensor is selected from the group comprising an ultrasonic sensor, a photoelectric sensor, a camera, radar, and an electromechanical switch.

19. The hopper regulation system of claim 17, wherein the object detection sensor is selected from the group comprising a camera, radar, and an ultrasonic sensor.

20. The hopper regulation system of claim 17, wherein the hopper operation is one of a material receiving operation in which a first hopper side, a second hopper side, and a hopper apron are positioned in a vertically lowered position to receive paving material from a material loading machine and a material feeding operation in which the first hopper side and the second hopper side are vertically tilted to direct paving material to a conveyor on the paving machine.

* * * * *